United States Patent [19]

Richards et al.

[11] Patent Number: 4,797,779

[45] Date of Patent: Jan. 10, 1989

[54] PULSED POWER SUPPLY

[75] Inventors: James A. Richards, Joliet; Ronald T. Stefanek, Lockport, both of Ill.

[73] Assignee: Folger Adam Company, Lemont, Ill.

[21] Appl. No.: 104,685

[22] Filed: Oct. 5, 1987

[51] Int. Cl.[4] ..... H01H 47/12; H01H 47/32

[52] U.S. Cl. ..... 361/154; 361/203

[58] Field of Search ..... 361/154, 155, 203; 70/280, 281, 282

[56] References Cited

U.S. PATENT DOCUMENTS

| | | | |
|---|---|---|---|
| 3,371,252 | 2/1968 | James | 361/154 |
| 3,579,052 | 5/1971 | Toyohashi-shi et al. | 361/203 |
| 4,593,543 | 6/1986 | Stefanek | 70/280 |
| 4,636,912 | 1/1987 | Ohtani | 361/154 |

OTHER PUBLICATIONS

Brochure; Schlage Electronics-Model 700 Hardware Drive Module.

Brochure-Synektron Corporation, Model 10-G100C17 Controlled Field Actuator.

Article-Electronic Products pp. 60-62 (undated).

*Primary Examiner*—L. T. Hix

*Assistant Examiner*—David Porterfield

*Attorney, Agent, or Firm*—Willian Brinks Olds Hofer Gilson & Lione

[57] ABSTRACT

A power supply for controlling a solenoid actuated lock includes high and low frequency pulse generators, the outputs of which control a switching transistor. The low frequency pulses seat the solenoid plunger, and the high frequency pulses maintain the plunger in the seated position.

10 Claims, 2 Drawing Sheets

V
12
6
T (SEC)

10
12
14
16
20
22
24
HF
LF 10
12
14
16
20
22
24
26
28
30
32
34
36
38
40
42
44
46
48
50
52
54
56
58
60
62
64
66
68

PULSED POWER SUPPLY

FIELD OF THE INVENTION

The invention relates to solenoid controlled actuators in general, and more particularly to power supplies for solenoid controlled door locks.

BACKGROUND OF THE INVENTION

Solenoid controlled door locks, for example those used in prisons or other security installations are well known in the art. An exemplary solenoid controlled lock is disclosed in U.S. Pat. No. 4,593,543, the specification of which is incorporated by reference. This lock includes a solenoid having high and low current coils that are wound in series. In the deenergized state, the solenoid plunger is fully extended and a normally closed switch shunts the low current winding. Upon the initial application of power to the solenoid, only the high current coil conducts. As the plunger approaches its fully retracted or seated condition, the switch is tripped, allowing both the high and low current coils to conduct and exert sufficient force to fully retract the plunger and maintain it in a seated condition.

This type of lock has the general disadvantage of requiring two coils and a thermal protector to prevent damage to the high current coil in case the switch is not activated, e.g., because the plunger is stuck, the lock has been tampered with, or due to field installation problems.

In locks using single coil solenoids, the power consumption of the coil is a significant concern. One commercially available power supply (Schlage Electronics Model 700 Hardware Drive Module) periodically provides a short duration overvoltage pulse to the coil to ensure that the plunger is in its seated position. The plunger is maintained in that position by a reduced holding voltage that is applied between overvoltage pulses. The lower holding voltage reduces the solenoid current and thereby decreases the overall power consumption of the lock.

Other known devices, for example, the Synektron Model 10-G100C17 Controlled Field Actuator (CFA), employ a Hall-effect sensor to control the application of high frequency voltage pulses to the solenoid by varying the duty cycle of the pulses as a function of the plunger stroke. Because of the nonlinear solenoid spring force, a greater force is required to move the plunger from an extended position than is required to hold the plunger in its seated position. To achieve the force necessary to move the plunger from an extended position, the width of the high frequency pulses is greatly increased. Conversely, as the plunger nears its seated position, the CFA automatically shortens the pulse width.

The duty cycle of the CFA pulse train varies throughout the entire range of plunger motion, however, the pulse frequency is constant. Thus, the CFA is a relatively complex servomechanism capable of performing more sophisticated functions than the simple on/off function required for lock applications. Moreover, because the Hall-effect sensor requires a special solenoid with 6 rather than 2 wires, it is not cost efficient to use a CFA for lock applications.

It is therefore an object of this invention to provide a simple inexpensive solenoid controlled lock that can be operated at reduced power levels.

SUMMARY OF THE INVENTION

The invention includes a pulsed power supply used to control a solenoid. The power supply provides three types of pulses; an initial seating pulse, continuous holding pulses, and retry pulses. The initial seating pulse is sufficient to drive the plunger its full stroke to a seated position. If for any reason the initial seating pulse does not seat the plunger, retry pulses capable of seating the plunger are provided. The retry pulses vary between full current and no current at a relatively low frequency. The holding pulses also vary between full current and no current but occur at a high frequency. The holding pulses are sufficient to maintain the solenoid plunger in its seated position, while significantly reducing power requirements.

The invention, together with further objects and advantages, will best be understood with reference to the following description of an embodiment, taken in conjunction with the drawings, in which:

DETAILED DESCRIPTION OF THE PRESENTLY PREFERRED EMBODIMENT

Figures 1, 2, 3:
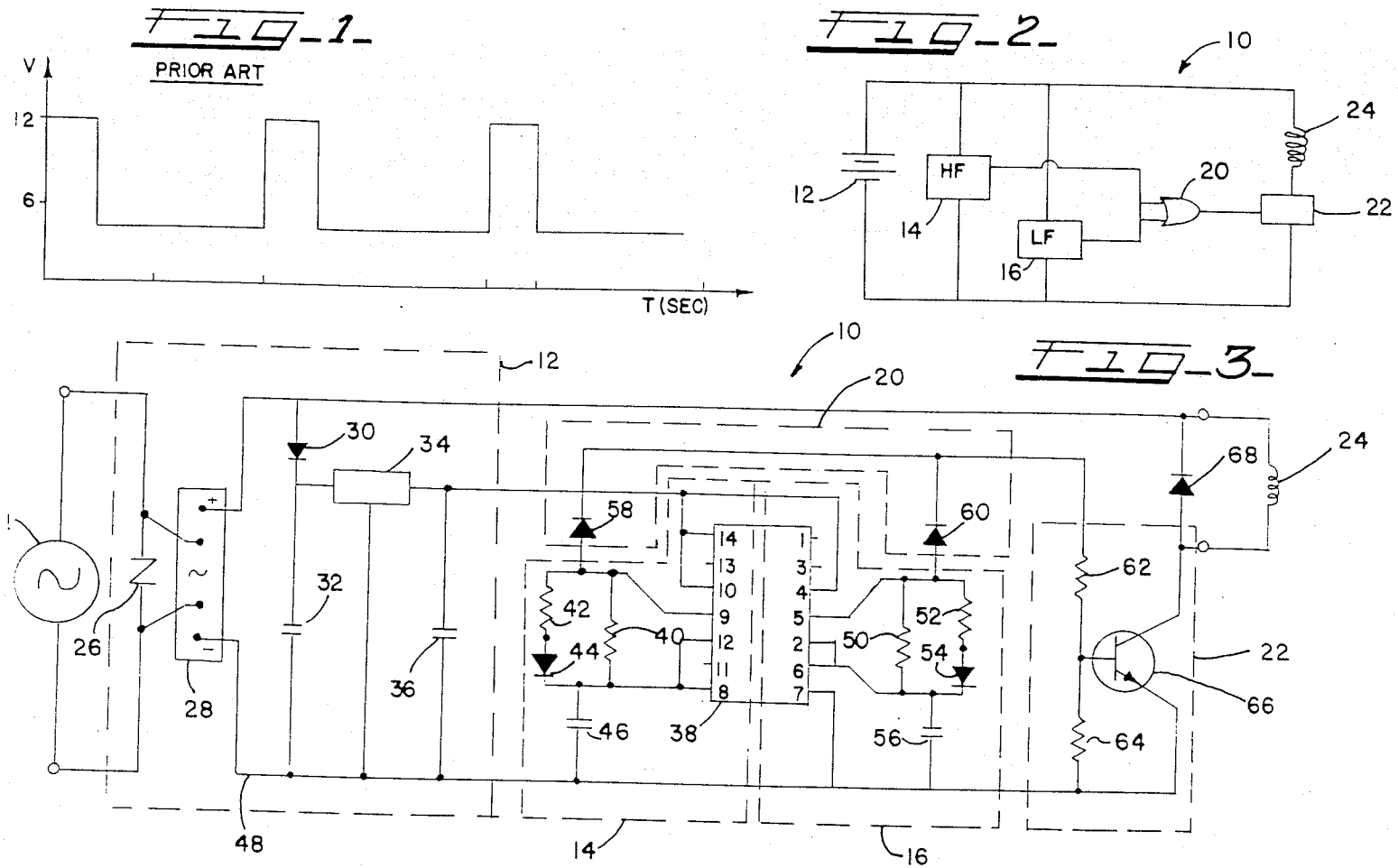
FIG-1 PRIOR ART
FIG. 1 is a depiction of the output waveform of a known variable voltage power supply.
FIG. 2 is a block circuit diagram of a presently preferred embodiment of the invention.
FIG. 3 is a detailed circuit diagram of the embodiment depicted in FIG. 2.

FIG. 1 depicts the output waveform of a Schlage Electronics Model 700 Hardware Drive Module. As shown, an overvoltage pulse is periodically applied to the solenoid to ensure that the plunger is fully seated. A reduced holding voltage (approximately 30% of the rated voltage) is applied at all other times to keep the plunger in the seated position.

FIG. 2 depicts the basic elements of the pulsed power supply 10 which comprises the invention. A D.C. power source 12 is connected to a high frequency pulse generator 14 and a low frequency pulse generator 16. The outputs of the pulse generators are connected to a logic OR gate 20. The output of gate 20 is used to control switching element 22 which permits current to flow through a solenoid coil 24.

FIG. 3 is a more detailed depiction of the elements of FIG. 2, in which like reference numerals refer to like components. The power supply 10 is typically connected to an AC power source 11. It may also be connected to a DC power source (not shown), in which case an internal bridge rectifier serves as a polarity protection device.

The DC voltage source 12 of FIG. 2 includes a surge suppressor 26 (FIG. 3) to prevent damage to the power supply circuitry caused by transients appearing on the AC power lines. In the preferred embodiment, surge suppressor 26 is a metal oxide varistor that has a peak voltage handling capacity of twice the nominal line voltage.

Connected in parallel with surge protector 26 is a standard bridge rectifier 28. The DC output of rectifier 28 is filtered by the series combination of diode 30 and capacitor 32. A voltage regulator 34 is connected across capacitor 32. The regulated output is filtered by capacitor 36 and applied to the power input of a timing integrated circuit 38, such as a NE556 dual timer.

The high frequency pulse generator 14 is formed in a known manner by connecting timer 38 to a resistor 40 in parallel with the series connection of a resistor 42 and a diode 44. The common connection of resistor 40 and diode 44 is connected to one terminal of a capacitor 46, the other terminal of which is connected to ground 48. Those skilled in the art will appreciate that the values of resistors 40, 42 and capacitor 46 determine the frequency of pulse generator 14. Resistor 42 in combination with diode 44 determines the duty cycle of the pulses. Those skilled in the art will realize that the combination of R42, R40, and C46 determine the frequency of high frequency pulse generator 14. The ratio of R40 to the series combination of R42 and D44 determine the duty cycle of pulse generator 14.

Similarly, the low frequency pulse generator 16 is formed by connecting a resistor 50 in parallel with the series connection of a resistor 52 and diode 54, and connecting that parallel arrangement in series with capacitor 56 to ground 48. Those skilled in the art will realize that the combination of R50, R52, and C56 determine the frequency of low frequency pulse generator 16. The ratio of R50 to the series combination of R52 and D54 determine the duty cycle of pulse generator 16.

The common connections of resistors 40 and 42 and resistors 50 and 52, i.e., the outputs of the two pulse generators 14, 16, are connected via diodes 58, 60 respectively to a series connection of resistors 64, 66. The diodes 58, 60 act as the logic OR gate 20 depicted in FIG. 2 to permit the application of either signal to the series resistors 62, 64.

Resistors 62, 64 in combination with a power transistor 66 form the switching circuitry 22 of FIG. 2. The base terminal of transistor 66 is connected to the common connection of resistors 62 and 64. The collector of taansistor 66 is connected via a snubber diode 68 to the output of rectifier 28. The solenoid coil 24 is connected across a snuffer diode 68. The emitter of transistor 66 is connected to ground 48.

As shown in FIG. 3, transistor 66 is a bipolar device. A properly configure FET (not shown) would also suffice. For an N channel FET, the gate would be connected to resistors 62 and 64, the drain to solenoid 24 and the source to ground.

In the presently preferred embodiment, the components are described by the following table.

| Reference | Identification |
|---|---|
| 26 | Rectifier, 2.0 A 200 V |
| 28 | V47ZA7 |
| 30 | IN 4002 |
| 32 | 47 microfarads/35 Volt |
| 34 | 78M15 |
| 36 | 3.3 microfarads/25 Volt |
| 38 | NE 556 |
| 40 | 1,500 ohms |
| 42 | 220 ohms |
| 44 | IN914 |
| 46 | .047 microfarads |
| 50 | 330,000 ohms |
| 52 | 12,000 ohms |
| 54 | IN914 |
| 56 | 22 microfarads/25 Volt |
| 58 | IN914 |
| 60 | IN914 |
| 62 | 180 ohms |
| 64 | 120 ohms |
| 66 | D44 H11 |

-continued

| Reference | Identification |
|---|---|
| 68 | IN 4002 |

It will be apparent to those skilled in the art that timer 38 in combination with resistors 40, 42 and capacitor 46 forms a pulse generator having a frequency of 16 Khz. In contrast, the combination of timer 38 capacitor 56 and resistors 50, 52 form a pulse generator having a frequency of 0.2 Hz.

Upon activation of the circuit, the low frequency pulse generator 14 produces an initial seating pulse of 0.4 seconds. The retry pulses are 0.2 seconds long and are produced every 5.1 seconds. Those of skill in the art will appreciate that the duty cycle of the low frequency pulse generator is approximately 4 percent.

At all times between retry pulses, high frequency pulse generator 16 produces pulses that are 14 microseconds in length at a duty cycle of approximately 20 percent.

Figure 4:
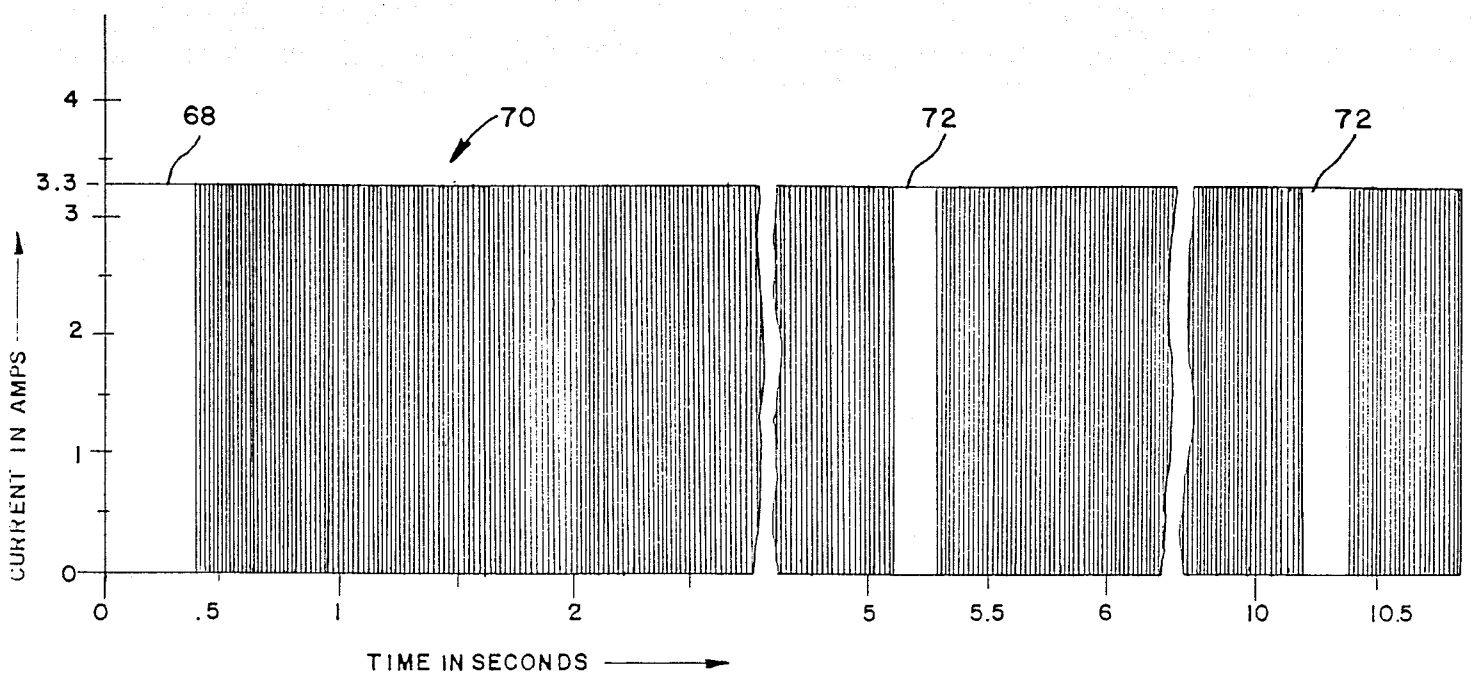
FIG. 4 is a depiction of the output waveform of the circuit of FIG. 3.

FIG. 4 depicts the relationship between the seating, holding and retry pulses. Pulse 68 is the initial 0.4 second seating pulse. It will not be repeated until the power supply 10 is deenergized and power is reapplied. Holding pulses 70 are applied at a 20% duty cycle to minimize power consumption and limit undesirable heating of the solenoid. These pulses are continuously applied until power supply 10 is deenergized. Retry pulses 72 are applied to seat the plunger in the event it has become unseated. These pulses are also continuously applied until power supply 10 is deenergized.

The low frequency retry pulses develop 100% of the solenoid's rated pull-in force (dissipating approximately 85 watts) during the 0.2 second pulses. In contrast, the high frequency holding pulses enable a 6.8 ohm solenoid to seat the plunger with 19 to 20 lbs of holding force and dissipate only 4½ watts of average power.

It should be understood that various changes and modifications to the preferred embodiment described herein will be apparent to those skilled in the art. Such changes and modifications can be made without departing from the spirit and scope of the present invention and without diminishing its attendant advantages. It is intended that the foregoing description be regarded as illustrative rather than limiting, and that it be understood that it is the following claims, including all equivalents, which are intended to define the scope of this invention.

We claim:

1. A power supply for controlling a solenoid actuated lock comprising:

a D.C. voltage source;

a solenoid connected to said voltage source, said solenoid having a coil and a plunger;

means for generating a first train of constant voltage pulses, the first pulse of said train being produced upon application of said D.C. voltage to said generating means and having a first pulse width, and all subsequent pulses having a pulse width less than said first pulse width;

means for generating a second pulse train, the pulses of said train being of constant voltage and of a frequency greater than said first pulse train; and switching means responsive to said first and second pulse trains for switching current through the coil of said solenoid, said first pulse train acting to seat the plunger of said solenoid, and said second pulse train acting to maintain said plunger in the seated position.

2. The power supply of claim 1 wherein the pulse width of said first pulse in said first train of pulses is 0.4 seconds and the pulse width of said subsequent pulses is 0.2 seconds.

3. The power supply of claim 2 wherein the pulses of said first pulse train occur at a frequency of approximately 0.2 hertz with a duty cycle of approximately 4 percent and the pulses of said second pulse train occur at a frequency of approximately 16K hertz with a duty cycle of approximately 20 percent.

4. The power supply of claim 1 wherein said first pulse train has a duty cycle of approximately 4 percent and said second pulse train has a duty cycle of approximately 20 percent.

5. A power supply for controlling a solenoid comprising:

a D.C. voltage source;

a solenoid having a first terminal connected to said voltage source;

means connected to a second terminal of said solenoid for alternately causing said solenoid to conduct current in response to a control signal;

means for producing a first signal having pulses of more than one predetermined pulse width, a predetermined frequency and an active state;

means for producing a second signal having a predetermined frequency that is greater than said first signal; and means connected to said first and second signal producing means and responsive thereto to produce said control signal, whereby said solenoid conducts current in accordance with said second signal whenever said first signal is not active.

6. A power supply for a solenoid activated lock comprising:

a D.C. voltage source;

a solenoid having two terminals, one of which is connected to said power source;

a switching transistor having its collector connected to the second terminal of said solenoid, and its emitter connected to ground, said transistor being responsive to a control signal applied to its base;

a first pulse generator, said first pulse generator generating an initial pulse and subsequent pulses having a pulse width less than said initial pulse;

a second pulse generator having an output frequency that is greater than said first pulse generator; and a logic OR gate connected to said first and second pulse generators, the output of which defines the control signal applied to the base of said transistor, whereby said transistor conducts and current flows through said solenoid whenever the output of said first or said second pulse generators is a logic One.

7. A power supply for a solenoid activated lock comprising:

a D.C. voltage source;

a solenoid having two terminals, one of which is connected to said power source;

a field effect transistor having its drain connected to the second terminal of said solenoid, and its source connected to ground, said transistor being responsive to a control signal applied to its gate;

a first pulse generator, said first pulse generator generating an initial pulse and subsequent pulses having a pulse width less than said initial pulse;

a second pulse generator having an output frequency that is greater than said first pulse generator; and a logic OR gate connected to said first and second pulse generators, the output of which defines the control signal applied to the gate of said transistor, whereby said transistor conducts and current flows through said solenoid whenever the output of said first or said second pulse generators is a logic One.

8. A power supply for controlling a solenoid actuated lock comprising:

a D.C. voltage source;

a solenoid connected to said voltage source, said solenoid having a coil and a plunger;

first pulse generating means for generating a seating pulse and periodic retry pulses, said seating pulse having a pulse width wider than said retry pulses;

second pulses generating means for generating holding pulses;

switching means responsive to said first and second pulse generating means for switching current through the coil of said solenoid, said seating and retry pulses acting to seat the plunger of the solenoid, and said holding pulses acting to maintain the plunger in its seated position.

9. The power supply of claim 8 wherein said seating pulse and retry pulses have a duty cycle of approximately 20 percent.

10. The power supply of claim 8 wherein said seating pulse and retry pulses occur at a frequency of approximately 0.2 hertz and said holding pulses occur at a frequency of approximately 16k hertz.

* * * * *

UNITED STATES PATENT AND TRADEMARK OFFICE

CERTIFICATE OF CORRECTION

PATENT NO. : 4,797,779

DATED : January 10, 1989

INVENTOR(S) : James A. Richards et al.

It is certified that error appears in the above-identified patent and that said Letters Patent is hereby corrected as shown below:

In column 3, line 38, please delete "taansistor" and substitute therefor --transistor--.

In column 3, line 40, please delete "snuffer" and substitute therefor --snubber--.

In column 3, line 43, please delete "configure" and substitute therefor --configured--.

Signed and Sealed this

Tenth Day of September, 1991

*Attest:*

HARRY F. MANBECK, JR.

*Attesting Officer*

*Commissioner of Patents and Trademarks*